US009888816B1

(12) United States Patent
Shaukat et al.

(10) Patent No.: US 9,888,816 B1
(45) Date of Patent: Feb. 13, 2018

(54) WEARABLE FLUID-DISPENSING APPARATUS

(71) Applicants: Kashif Shaukat, Davie, FL (US); Bernard Lagroue, Miramar, FL (US)

(72) Inventors: Kashif Shaukat, Davie, FL (US); Bernard Lagroue, Miramar, FL (US)

( * ) Notice: Subject to any disclaimer, the term of this patent is extended or adjusted under 35 U.S.C. 154(b) by 0 days.

(21) Appl. No.: 15/169,916

(22) Filed: Jun. 1, 2016

Related U.S. Application Data

(60) Provisional application No. 62/189,887, filed on Jul. 8, 2015.

(51) Int. Cl.

| | |
|---|---|
| ***A47K 5/12*** | (2006.01) |
| ***B05B 11/00*** | (2006.01) |
| ***B05B 9/08*** | (2006.01) |
| ***A44C 5/00*** | (2006.01) |
| ***A44C 5/14*** | (2006.01) |
| ***A44C 5/20*** | (2006.01) |

(52) U.S. Cl.
CPC ..... *A47K 5/1201* (2013.01); *A44C 5/0007* (2013.01); *A44C 5/14* (2013.01); *A44C 5/20* (2013.01); *A47K 5/1211* (2013.01); *B05B 9/085* (2013.01); *B05B 11/3014* (2013.01); *A47K 5/1202* (2013.01); *A47K 5/1204* (2013.01); *A47K 5/1205* (2013.01); *A47K 5/1207* (2013.01)

(58) Field of Classification Search
CPC ... A47K 5/1211; A47K 5/1201–5/1202; A47K 5/1204–5/1205; A47K 5/1207; A44C 5/0007; A44C 5/14; A44C 5/20; B05B 9/085; B05B 11/3014
USPC ..... 222/175, 180, 325–327, 153.01–153.14, 222/321.7–321.9, 209, 82–83, 131, 385; 239/154, 329
See application file for complete search history.

(56) References Cited

U.S. PATENT DOCUMENTS 4,057,176 A * 11/1977 Horvath ..... B05B 11/0018 222/153.13
5,924,601 A * 7/1999 Chen ..... F41H 9/10 222/175
5,927,548 A * 7/1999 Villaveces ..... A45F 5/02 222/175

(Continued)

*Primary Examiner* — Paul R Durand
*Assistant Examiner* — Andrew P Bainbridge
(74) *Attorney, Agent, or Firm* — Glenn E. Gold, P.A.; Glenn E. Gold; David Colls

(57) ABSTRACT

An antibacterial dispensing bracelet includes a frame having a receptacle receiving a removable cartridge defining an interior reservoir for containing a quantity of antibacterial fluid. A finger-activated pump assembly is mounted to the frame proximate to the receptacle and engages an extraction port in the cartridge for extracting antibacterial fluid. The pump assembly further defines a nozzle port for dispensing the antibacterial fluid therethrough by activation of a piston of the pump assembly being mounted in a housing of the pump assembly and movable between raised and depressed positions. The pump assembly also includes a spring biasing the piston to the raised position and a conduit extending in the cartridge to the extraction port thereof. The conduit, housing, and piston define a fluid pathway between the cartridge and nozzle port. A wristband extends from each side of the frame for securing about an arm of a user.

16 Claims, 9 Drawing Sheets

(56) References Cited

U.S. PATENT DOCUMENTS

| | | | | |
|---|---|---|---|---|
| 6,234,357 | B1 * | 5/2001 | Lewis | A45F 5/02 222/175 |
| 6,983,864 | B1 * | 1/2006 | Cagle | B05B 11/0005 222/131 |
| 6,990,047 | B1 * | 1/2006 | Barbagiovanni | A44C 5/0015 222/175 |
| 7,316,332 | B2 * | 1/2008 | Powers | A45D 34/00 222/1 |
| 7,988,020 | B2 * | 8/2011 | Shoham | A61B 90/80 222/175 |
| 8,286,834 | B2 * | 10/2012 | Powers | A45D 34/00 222/175 |
| 8,313,009 | B2 * | 11/2012 | Parisi | F41H 9/10 222/153.11 |
| 8,857,668 | B2 * | 10/2014 | Auerbach | B05B 11/0027 222/153.13 |
| 8,973,788 | B1 * | 3/2015 | Burns | A47K 5/1201 220/751 |
| 2003/0150876 | A1 * | 8/2003 | Walters | B05B 11/3001 222/153.13 |
| 2008/0251539 | A1 * | 10/2008 | Yapaola | A44C 5/003 222/175 |
| 2011/0240675 | A1 * | 10/2011 | McDoanald | B05B 15/061 222/180 |
| 2013/0037572 | A1 * | 2/2013 | Yapaola | B05B 11/0043 222/175 |

* cited by examiner

WEARABLE FLUID-DISPENSING APPARATUS

CROSS REFERENCE(S) TO RELATED APPLICATION(S)

This U.S. non-provisional patent application claims the benefit of U.S. provisional patent application No. 62/189,887, filed Jul. 8, 2015, which incorporated-by-reference herein its entirety.

FIELD OF THE INVENTION

The present invention relates to application of a fluid, such as an antibacterial composition, to an individual's hands and, more particularly, is concerned with a wearable fluid-dispensing apparatus for dispensing, among other things, an antibacterial fluid composition.

BACKGROUND OF THE INVENTION

Concerns about personal hygiene have become increasingly prevalent in modern society. With seemingly ever increasing frequency we hear of spreading viruses, threats of epidemics, and a general heightened awareness of the multitude of germs that we come in contact with every day. For most people, good hygiene is so much an integral part of their daily routine that they think little about it. Among other hygienic practices, for example, individuals wash their hands before and after preparing and/or eating food, and after handling an object or coming into contact with a potentially unsanitary surface. Various products are available to help sanitize an individual's hands, such as wipes infused with a liquid antibacterial solution, antibacterial soaps, and the like.

Consequently, the population as a whole has become ever more conscious of the danger posed by pathogens such as *E. coli*, Ebola, the growing threat of the bird flu virus and other viruses, as well as the more common pathogens an individual comes into contact with on a daily basis. The constant exposure to a wide variety of bacteria and viruses, particularly through contact with unsanitary surfaces, has the potential to cause any one of a number of undesirable infections. The acquisition and transfer of bacteria via a person's hands is recognized as a major factor in the spread of disease. Thus, antibacterial products for hand washing are formulated to reduce the number of bacteria on a person's hands more effectively than plain soap. In response to this threat, many businesses offer their patrons access to antibacterial products. For instance, supermarkets commonly offer antibacterial wipes for consumers to use to wipe the handle of a shopping cart, as well as antibacterial dispensers in areas dedicated for bottle returns and the like.

However, not every business encountered by consumers offer access to complementary antibacterial products. Further, individuals frequently experience unsanitary situations throughout the day where it is impractical to immediately wash one's hands with soap and water, or to carry a commercially available container of antibacterial solution or a dispenser of antibacterial wipes. Therefore, as an insight by the inventor herein, it would be highly desirable to provide a fashionable wearable device having a means for storing, and quickly and efficiently dispensing, a quantity of antibacterial solution onto the hands of a wearer of the device. Furthermore, as another insight by the inventor herein, it would be desirable to provide such an apparatus wherein a volume of such a solution or composition could be provided within a disposable cartridge adapted to be releasably engaged with a dispensing mechanism integrated into the device.

SUMMARY OF THE INVENTION

The present invention, in accordance with the aforementioned insights by the inventor herein, is generally directed to an innovation providing a wearable fluid-dispensing apparatus in the form of an antibacterial fluid-dispensing bracelet having an antibacterial fluid-containing cartridge defining an interior reservoir for retaining a quantity of antibacterial composition in a fluid form and having an extraction port. The bracelet includes a frame defining a central receptacle that is conformally shaped to selectively receive the antibacterial fluid-containing cartridge, wherein the frame has first and second lateral side walls. The bracelet also includes a finger-activated pump assembly mounted proximate to the central receptacle of the frame and engaging the extraction port of the cartridge for selectively extracting the antibacterial fluid from the cartridge. The pump assembly has at least one nozzle port for dispensing the antibacterial fluid therethrough in response to activation of the pump assembly. The pump assembly also has a housing portion, a piston within the housing portion that is movable between a raised position and a depressed position, a compression spring for biasing the piston to the raised position, and a fluid extraction conduit fixedly integrated into the cartridge interior extending proximate to the extraction port of the cartridge. The conduit, housing portion, and pump assembly piston define a fluid pathway between the cartridge interior and the nozzle port. The bracelet further includes a female wristband segment extending from proximate the first lateral side wall of the frame and terminating at a first distal end portion, and a male wristband segment releasably securable to the female wristband segment, extending from proximate the second lateral side wall of the frame, and terminating at a second distal end portion. Together the first and second female and male wristband segments are releasably attachable to one another so as to enable the bracelet to be releasably secured to the wrist of a user.

These and other features, aspects, and advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF THE INVENTION

Figure 1:
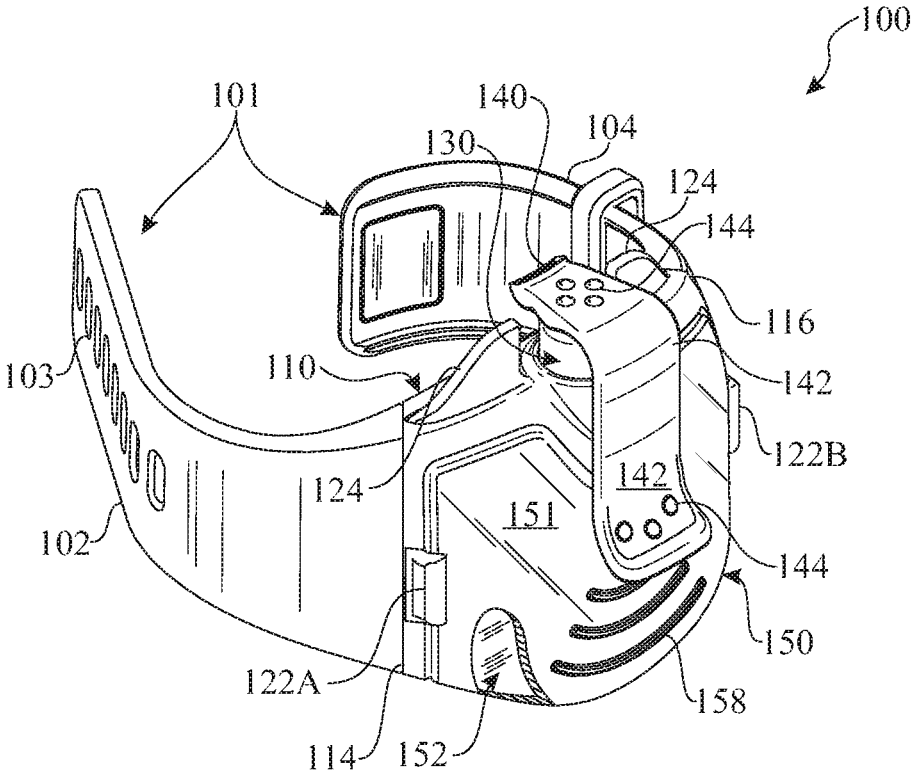
FIG. 1 presents an upper front isometric view of an exemplary embodiment of a wearable fluid-dispensing apparatus in the form of an antibacterial fluid-dispensing bracelet in accordance with aspects of the present invention.
Figure 2:
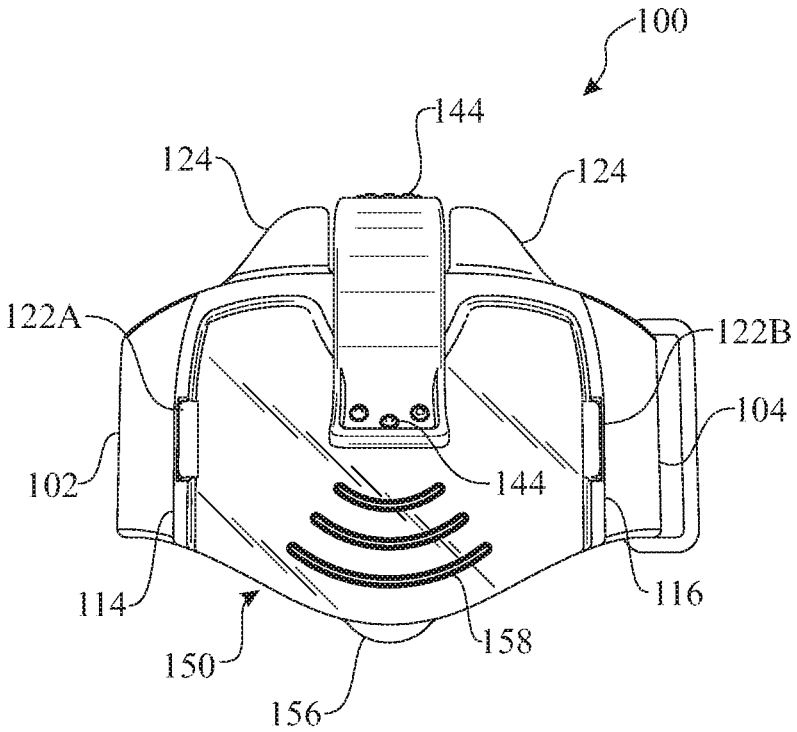
FIG. 2 presents a front elevation view of the antibacterial fluid-dispensing bracelet originally introduced in FIG. 1.
Figure 3:
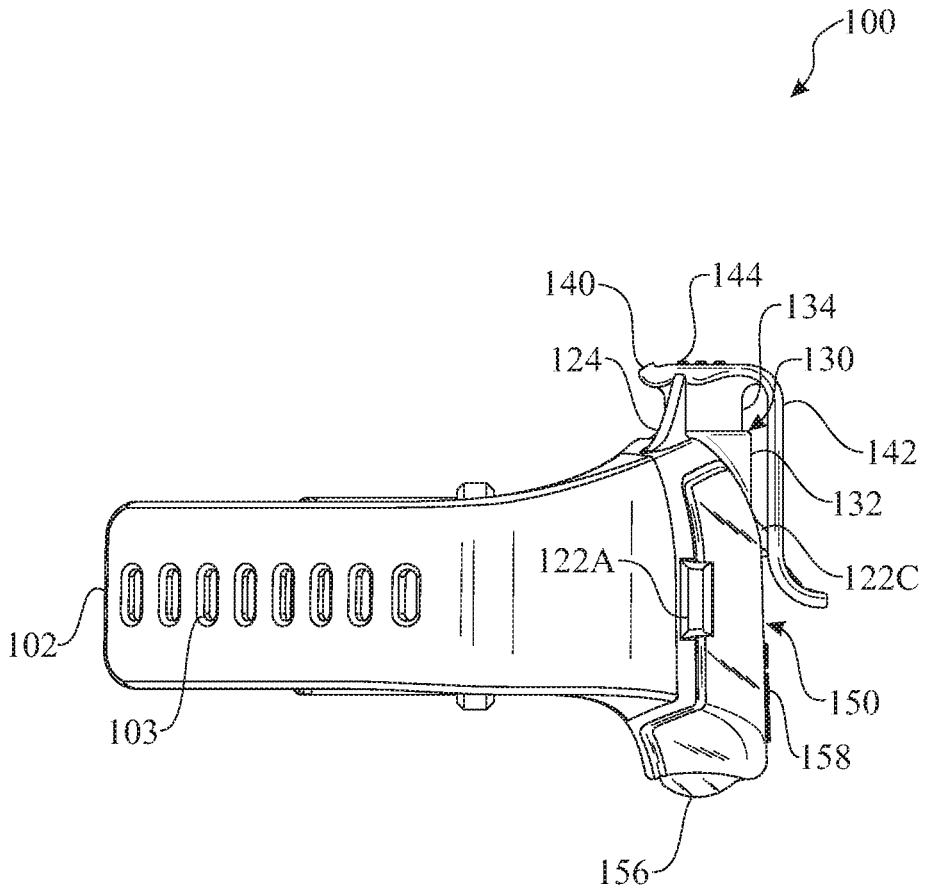
FIG. 3 presents a side elevation view of the antibacterial fluid-dispensing bracelet originally introduced in FIG. 1 and as seen from left of the bracelet in FIG. 2.
Figure 4:
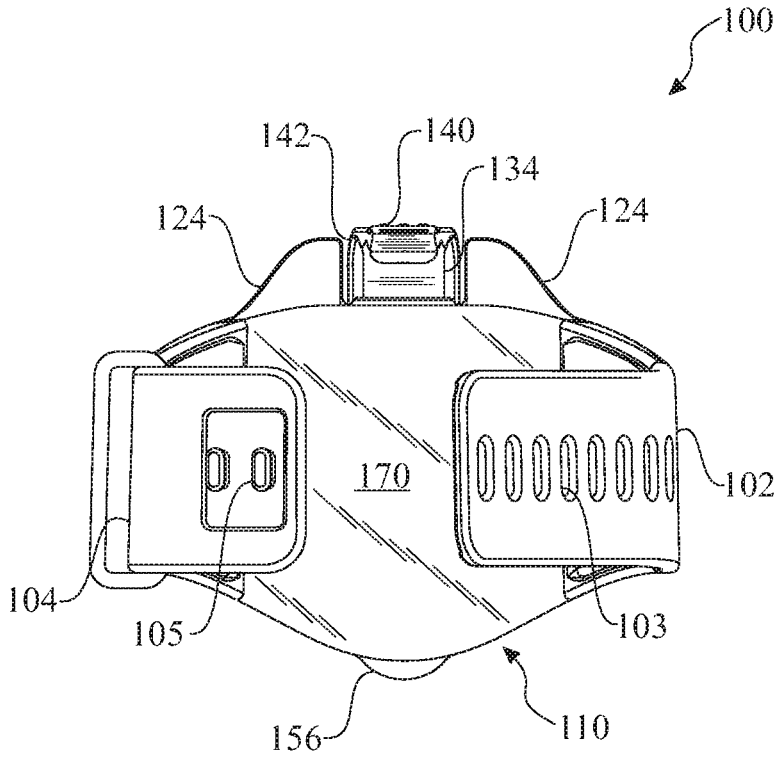
FIG. 4 presents a rear elevation view of the antibacterial fluid-dispensing bracelet originally introduced in FIG. 1.
Figure 5:
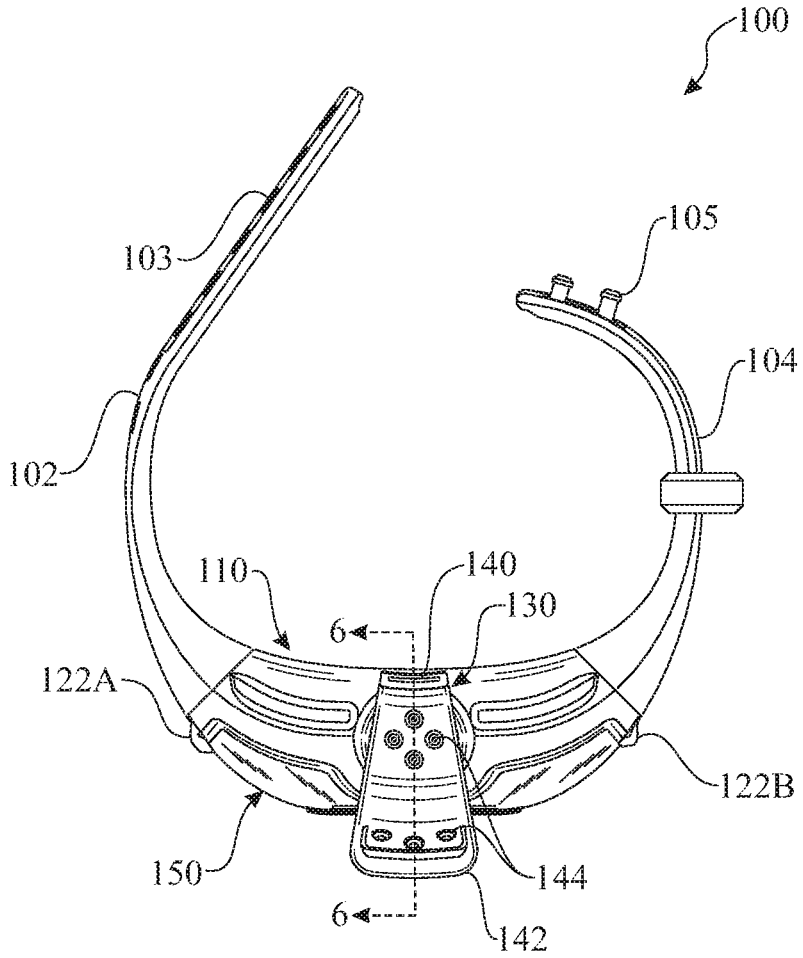
FIG. 5 presents a top plan view of the antibacterial fluid-dispensing bracelet originally introduced in FIG. 1.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to accompanying FIGS. 1-9, there is illustrated, in an exemplary implementation embodying aspects of the present invention, a wearable fluid-dispensing apparatus, generally designated 100, in the form of a fluid-dispensing bracelet, preferably wearable about the wrist/forearm of an individual. The bracelet 100 generally includes a frame 110, and a finger-activatable pump assembly 130 supported, and an arcuate-shaped receptacle 120 (FIGS. 7 and 8) defined, by the frame 110. The frame 110 has a slightly curved bottom wall 115 and a pair opposite first and second lateral side walls, 114 and 116 flared outwardly in opposite directions from a pair of opposite side edges of the bottom wall 115, respectively, defining the central receptacle 120, which is sized, shaped and otherwise has a geometry to conform with and receive a cartridge 150 containing a fluid, such as of an antibacterial fluid. While the wearable fluid-dispensing bracelet 100 can be used with a cartridge 150 containing any fluid, it is best suited for use with fluids, such as an antibacterial fluid, sunscreen, etc., to be used on the body of the wearer.

The frame 110 also may have a pair of integral clasps, 122A and 122B, extending from the corresponding respective lateral side walls, 114 and 116, for releasable engagement with the antibacterial fluid-containing cartridge 150 to aid in retaining the cartridge within the central receptacle 120 of frame 110. Preferably, the clasps 122A, 122B are integrally molded with lateral side walls 114, 116 of the frame 110 to form a unitary structure, wherein the clasps are resilient vis-á-vis the frame 110 to enable deflection of the clasps for snap-fitting engagement with cartridge 150, in a manner well known in the art. Those practiced in the art will readily recognize that the clasps can also assume other configurations known in the art.

The wearable fluid-dispensing apparatus or bracelet 100 also includes a wearable member 101 formed by a female wristband segment 102 and a male wristband segment 104. The female wristband segment 102 is affixed to the frame 110 proximate the first lateral side wall 114. The female wristband segment 102 has a series of spaced-apart apertures 103 along a length thereof to aid in fastening the bracelet 100 to a user's wrist or forearm. In like manner, the male wristband segment 104 is affixed to the frame 110 proximate the second lateral side wall 116. The male wristband segment 104 may include one or more pegs 105, or comparable projections, extending therefrom for releasable engagement with selected ones of the apertures 103 of the female wristband 102 to releasably secure the bracelet 100 to a user's wrist or forearm, in a manner well known in the art. Those practiced in the art will recognize that other known configurations of the wearable member 101 attached to the frame 110 are contemplated herein.

Figure 6A:
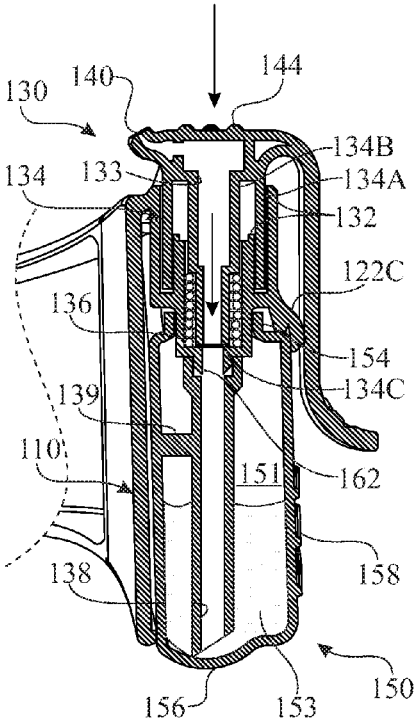
FIG. 6A presents a cross-sectional view of the antibacterial fluid-dispensing bracelet originally introduced in FIG. 5, and as taken along section line 6-6 of FIG. 5, wherein a finger-activated pump assembly of the fluid-dispensing bracelet is shown in a downwardly-biased (pressure applied) dispensing state.
Figure 6B:
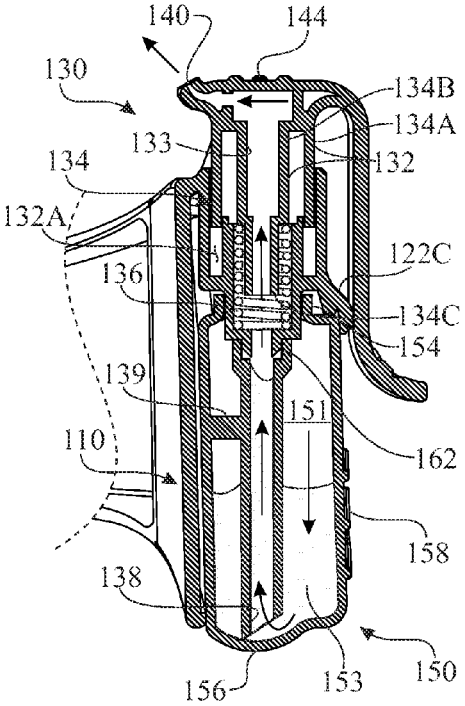
FIG. 6B presents a cross-sectional view of the antibacterial fluid-dispensing bracelet originally introduced in FIG. 5, and as taken along section line 6-6 of FIG. 5, wherein the pump assembly of the fluid-dispensing bracelet is shown in an equilibrium (unbiased) state.
Figure 7:
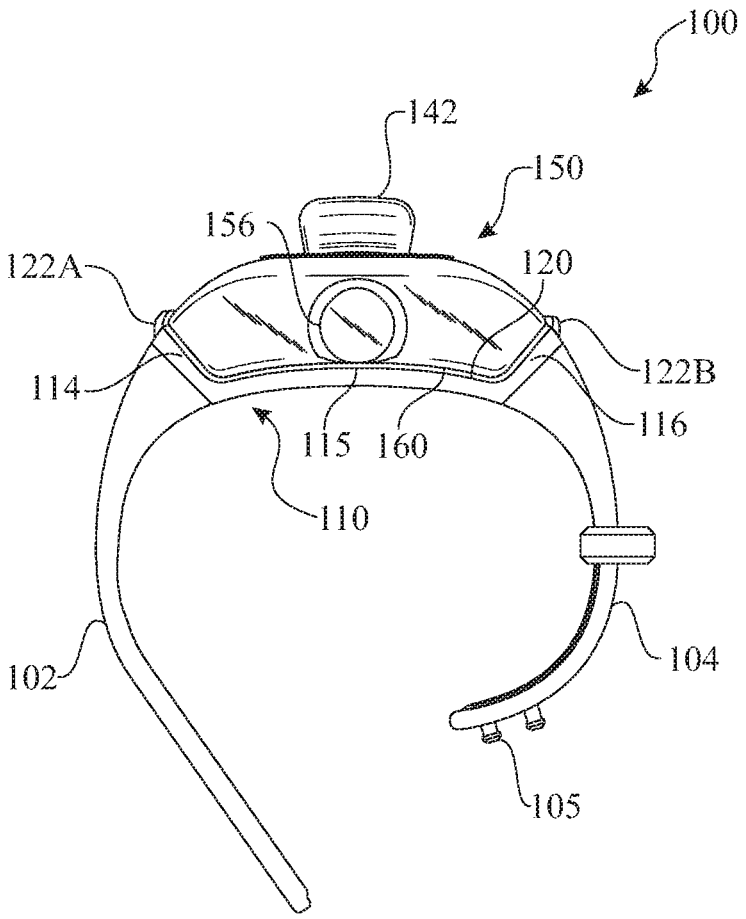
FIG. 7 presents a bottom plan view of the antibacterial fluid-dispensing bracelet originally introduced in FIG. 1.
Figure 8:
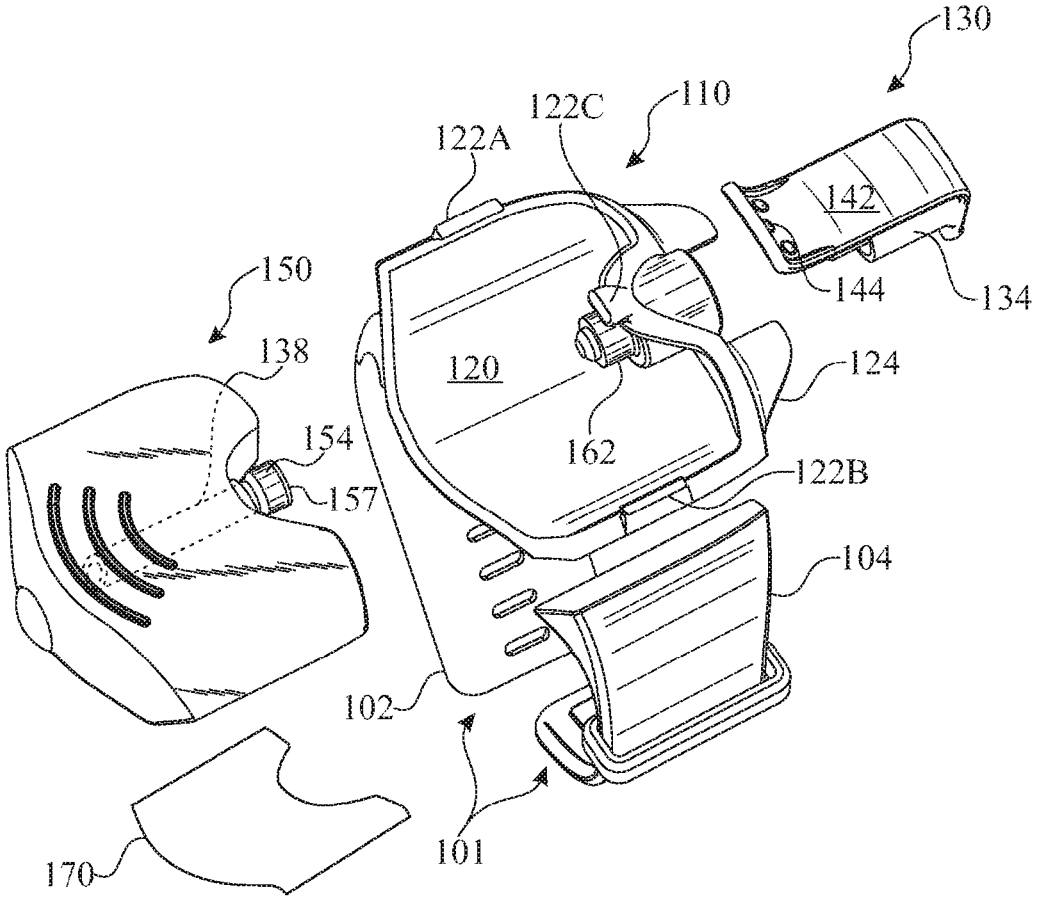
FIG. 8 presents an exploded isometric view of the antibacterial fluid-dispensing bracelet originally introduced in FIG. 1.

Referring now particularly to FIGS. 1, 6A and 6B, fluid-containing cartridge 150 has a body defining an interior reservoir 152 for retaining a volume of antibacterial fluid 153 and is retained within frame 110 by lateral clasps 122A, 122B and a central clasp 122C on an upper wall of frame 110 proximate to the central receptacle 120 and at one end of the bottom wall 115 and opposite first and second lateral side walls 114, 116 thereof. A grip area 158 can be included on the front exterior surface 151 of the cartridge 150 to aid in the removal and insertion of the cartridge 150. As best seen in FIG. 8, the cartridge 150 also defines an annular-shaped extraction port 154 at a top center thereof for engagement with an annular housing 132 of the finger-activatable pump assembly 130, as described below. A bulge 156 (see also FIGS. 2-4) is formed at a central bottom portion of the cartridge 150 to provide a low point for pooling of the antibacterial fluid when the fluid level is at a minimum, in order to minimize waste of the antibacterial fluid. A rear exterior surface 160 (FIG. 7) of cartridge 150 can also include a label 170 applied thereto wherein the label 170 includes descriptive and usage information related to the fluid retained therein. In this case, it is preferable that the cartridge is constructed of a translucent (clear) material. This also facilitates viewing through the cartridge to determine the relative quantity of fluid remaining. Although not depicted, it will be apparent to those skilled in the art that the cartridge 150 may be constructed having hash marks for determining the remaining volume of fluid 153.

As best illustrated in FIGS. 1, 3, 6A and 6B, the finger-activatable pump assembly 130 at the annular housing 132 thereof is affixed to, or at regions thereof is integrally formed with, the upper wall of the frame 110. The pump assembly 130 thus includes the annular-shaped housing 132, preferably having a double-walled structure (as shown in FIGS.

6A and 6B) at an upper portion of the housing. The pump assembly 130 also includes a piston 134 vertically slidable within and supported by the annular housing 132. The piston 134 includes a pair of spaced apart exterior and interior walled portions 134A and 134B and a bottom walled portion 134C attached to, and offset inwardly and extending downwardly from, the interior walled portion 134B. The exterior walled portion 134A of the piston 134 is slidably retained in an annular slot 132A formed within and defined by the double-walled structure of the annular housing 132. The interior walled portion 134B of the piston 134 seats on a top end of, and the bottom walled portion 134C of the piston 134 extends downward through, a centrally-located biasing spring 136 supported in the annular slot 132A of the annular housing 132. The interior and bottom walled portions 134B and 134C of the piston 134 define a centrally-located extraction passageway 133 through the piston 134 and into fluid communication with a fluid transfer conduit 138 of the cartridge 150, as described further hereinbelow.

The piston 134 of the pump assembly 130 is translatable between a raised position (FIG. 6B) and a depressed position (FIG. 6A). The piston 134 defines at an upper portion thereof, protruding beyond the annular housing 132, a nozzle port 140 from which a quantity of fluid, pumped upwardly from the cartridge 150, through the fluid transfer conduit 138 and the extraction passageway 133, is dispensed during activation of the pump assembly 130. An upper end of the biasing spring 136, such as a compression spring, engages the interior walled portion 134B of the piston 134 to bias the piston 134 in the raised position (FIG. 6B). The fluid transfer conduit 138 is fixedly attached to the sidewall of the cartridge 150 via an attachment structure 139 such that the conduit 138 is fixedly retained in a generally vertically disposed orientation with a lower end extending into cartridge bulge 156 and an upper end fitted about a lower portion of the annular housing 132 defining a lower port 162 of the pump assembly 130. The annular housing 132 of the pump assembly 130, above the lower port 162 thereof, snugly fits through the extraction port 154 of the cartridge 150 such that the piston 134 communicates via the extraction passageway 133 through the interior and bottom walled portions 134B and 134C thereof with the interior reservoir 152 of the cartridge 150. A lower end of the biasing spring 136 is seated on an annular shoulder in the extraction port 154. The fluid transfer conduit 138, the annular housing 132, and the piston 134 define a fluid pathway extending, centrally through the biasing spring 136, between the interior reservoir 152 (FIG. 1) of the antibacterial fluid-containing cartridge 150 and the fluid extraction passageway 133 just shy of the nozzle port 140.

The annular housing 132 of the pump assembly 130 closely fits or engages with the extraction port 154 of the antibacterial fluid-containing cartridge 150 when the cartridge 150 is fully engaged with the frame 110 and retained in place by the clasps 122A, 122B and 122C, and provides a leak-proof seal at the extraction port 154. The fluid transfer conduit 138 at its upper end is spaced below the extraction port 154 of the cartridge 150 and extends downward through the interior reservoir 152 of the cartridge 150 substantially to the bottom of the cartridge bulge 156 for maximum extraction of the antibacterial fluid therein. The upper wall of the frame 110 can also include fixed risers 124 which are disposed on either side of the upper portion of the piston 134 proximate to the nozzle port 140 thereof to protect the piston 134 of the pump assembly 130 from inadvertent activation or from catching on clothing or other articles.

The piston 134 of the finger-activatable pump assembly 130 can also include a grip surface 144 at a top portion thereof so that the user can get a tactile indication of when the user's finger is properly positioned to activate the pump assembly 130. Additionally, a lever 142 can be affixed to the piston 134 for activation thereof and also includes a grip surface 144 at an end thereof for further tactile feedback to the user. As illustrated in FIGS. 6A and 6B, the piston 134 and the lever 142 are integrally molded as a single unit; however other configurations of the piston 134, the nozzle port 140, and the lever 142 are contemplated.

Referring briefly primarily to FIGS. 6A and 6B, during use a user initially activates, by depressing, the piston 134 of the pump assembly 130 as depicted by the downward arrows in FIG. 6A, and then de-activates, by releasing, the piston of the pump assembly, creating a vacuum that draws a volume of fluid 153 up through conduit 138 into fluid extraction passageway 133. Subsequently, upon once again activating, by depressing, the piston 134 of the pump assembly 130, pressure forces a volume of the fluid 153 out through nozzle port 140 into the user's hand for subsequent application to the hands and/or other body parts as desired.

Figure 9:
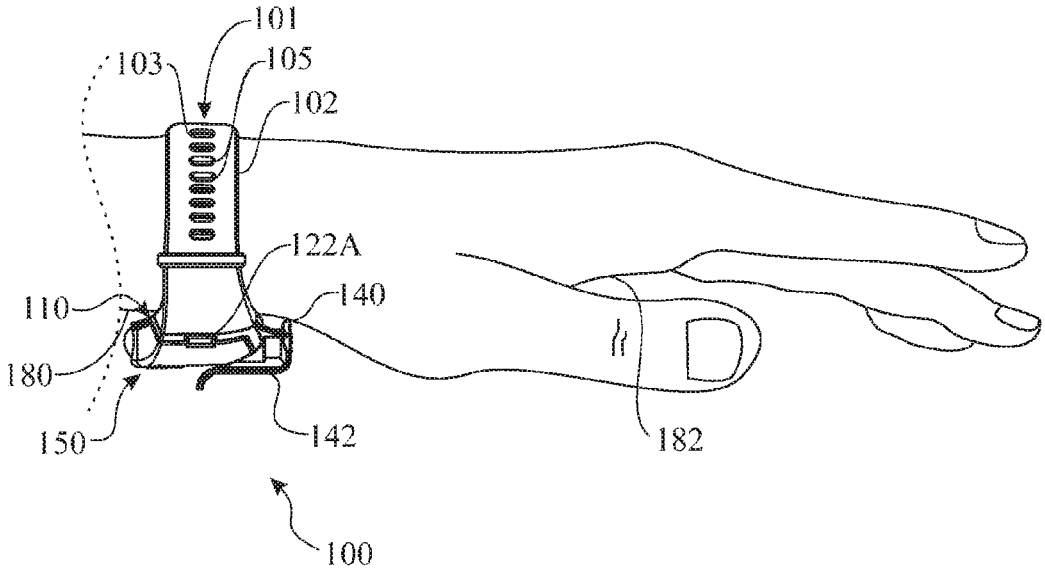
FIG. 9 presents a side elevation view of the antibacterial fluid-dispensing bracelet originally introduced in FIG. 1 being shown worn on the wrist of a user.

In use, and as illustrated in FIG. 9, the antibacterial (or other composition of solution) fluid-dispensing bracelet 100 can be worn by a user by placing the frame 110 against an inner portion of the user's wrist 180 and orienting the nozzle port 140 toward the user's inner hand 182. The wristband strap, formed by the female and male wristband segments 102 and 104, is maneuvered to encircle the user's wrist 180 wherein one or more pegs 105 of male wristband segment 104 are engaged in apertures 103 of female wristband segment 102 to secure the antibacterial fluid-dispensing bracelet 100 in place upon the user's wrist 180. With the bracelet 100 securely in place, the user may go about daily activities. When the situation arises that the user wishes to dispense a quantity of antibacterial fluid, the user places a finger on the grip 144 of either the piston 134 or the lever 142 and then activates, by depressing, the piston 134. This will force a quantity of the antibacterial fluid through the nozzle port 140 in the direction of the inner hand 182 of the user.

When the quantity of antibacterial fluid has been depleted from the interior reservoir 152 of the antibacterial fluid-containing cartridge 150, the user unfastens the clasps 122 from engagement with the cartridge 150 and placing a thumb or finger on the grip portion 158 of the cartridge 150 slides the cartridge 150 downward to disengage from the pump subassembly 130 and frame 110. A new cartridge 150 may then be installed by positioning and sliding the extraction port 154 of the cartridge 150 over the lower port 162 of the housing portion 132 of the pump assembly 130 to tear through a cartridge-opening sealing membrane 157 (FIG. 8) to thereby initiate fluid communication between the cartridge interior 152 and the finger pump fluid extraction passageway 133, via the conduit 138. Additional quantities of antibacterial, or other composition, fluid can then be extracted by activation of the piston 134 of the pump assembly 130 as previously described.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents. By way of example, although the exemplary implementation of the present invention has been described particularly for in conjunction with antibacterial fluid-dispensing cartridges, it is contemplated that the invention will be employed for use with cartridges containing other fluids including, for example, sunscreen, insect repellent and any other compositions available in a fluid form useful for being carried by a person for convenient dispensing and rubbing onto the skin, hair, etc., of the individual's body (or another individual's body).

What is claim is:

1. A wearable fluid-dispensing apparatus, comprising:

a cartridge comprising a cartridge body defining an interior reservoir for containing a quantity of a fluid, an extraction port on said cartridge body for extracting fluid from said interior reservoir, and a fluid transfer conduit having opposite lower and upper ends and being disposed in said interior reservoir of said cartridge body so as to extend from said lower end located proximate a bottom of said cartridge body to said upper end located proximate said extraction port;

a frame comprising a plurality of walls defining a receptacle shaped to conform to a shape of an exterior of said cartridge in order to selectively receive said cartridge, and an upper wall extending laterally from an end of said plurality of walls proximate to said receptacle defined by said plurality of walls;

a finger-activated pump assembly mounted to said upper wall of said frame proximate to said receptacle of said frame and engaging said extraction port of said cartridge body, said pump assembly comprising an annular-shaped housing affixed to said upper wall of said frame proximate to said receptacle of said frame, said annular-shaped housing having an upper portion having a double-walled structure defining an annular slot within said double-walled structure and open at an upper end thereof, and a lower portion connected to said double-walled structure of said upper portion, extending into said cartridge body through said extraction port thereon, and defining a port that fits and communicates with said upper end of said fluid transfer conduit of said cartridge body received by said receptacle of said frame, a piston slidably supported by said annular-shaped housing, said piston comprising an exterior walled portion slidable within said annular slot defined by said double-walled structure of said upper portion of said annular-shaped housing such that said piston is translatable between a raised position and a depressed position relative to said annular-shaped housing, an interior walled portion spaced from said exterior walled portion and slidable concurrently therewith and along and inside of said double-walled structure of said upper portion of said annular-shaped housing so as to define an extraction passageway through said piston and in fluid communication with said fluid transfer conduit of said cartridge such that said piston of said piston assembly upon being activated, by a user depressing said piston from said raised position to said depressed position, selectively extracts the fluid from said interior reservoir of said cartridge body through said fluid transfer conduit and extraction port of said cartridge body and said extraction passageway of said piston, a biasing spring disposed within said annular-shaped housing along and engaged with said upper and lower portions thereof and also engaged with said interior walled portion of said piston so as to bias said piston toward said raised position, at least one nozzle port defined on said piston, at a location on said upper portion of said piston disposed beyond said double-walled structure of said upper portion of said annular-shaped housing, in fluid communication with said extraction passageway of said piston to dispense the extracted fluid therethrough and from said fluid-dispensing apparatus in response to said depressing said pump from said raised position to said depressed position, and fixed risers mounted on said upper wall of said frame and disposed on either side of said upper portion of said piston proximate to said nozzle port thereof to protect said piston from inadvertent activation and contact; and a wearable member attached to and extending from said frame so as to be extendable about and thus wearable by a body portion of a user.

2. The apparatus of claim 1 wherein said wearable member comprises:

a first wristband segment attached to and extending from said first side of said frame and terminating at a first distal end portion; and a second wristband segment attached to and extending from said second side of said frame and terminating at a second distal end portion, said second distal end portion inter-engageable with said first distal end portion to secure said apparatus to an arm of a user.

3. The apparatus of claim 2 wherein said first distal end portion of said first wristband segment has a series of spaced-apart apertures along a length thereof.

4. The apparatus of claim 3 wherein said second distal end portion of said second wristband segment has one or more projections extending therefrom for releasable engagement with selected ones of said apertures of said first wristband to releasably secure said apparatus to the arm of the user.

5. The apparatus of claim 1 wherein said plurality of walls of said frame comprises:

a bottom wall; and opposite first and second lateral side walls extending from opposite sides of said bottom wall and defining therewith said receptacle conformally shaped to selectively receive said cartridge.

6. The apparatus of claim 5 wherein said bottom wall and said opposite first and second lateral side walls of said receptacle have an arcuate shape.

7. The apparatus of claim 6 wherein said bottom wall of said receptacle has a slightly curved shape.

8. The apparatus of claim 7 wherein said opposite first and second lateral side walls of said receptacle are flared outwardly in opposite directions from said bottom wall.

9. The apparatus of claim 5 wherein said frame further comprises:

a pair of side clasps each extending from a respective one of said first and second lateral side walls of said frame into releasable engagement with said cartridge to aid in retaining said cartridge within said receptacle of said frame.

10. The apparatus of claim 9 wherein said frame further comprises a central clasp extending from said upper wall of said frame for assisting said releasable engagement of said side clasps with said cartridge to aid in retaining said cartridge within said receptacle of said frame.

11. The apparatus of claim 1 wherein said cartridge has a grip area is defined on a front exterior surface of said cartridge to aid in removal and insertion of said cartridge from and to said receptacle of said frame.

12. The apparatus of claim 1 wherein said piston of said pump assembly has a grip surface at a top portion thereof so that the user can get a tactile indication of when a finger of the user is properly positioned to activate said pump assembly.

13. The apparatus of claim 1 wherein said pump assembly further comprises a lever affixed to said piston for activation thereof by the user.

14. The apparatus of claim 13 wherein said lever has a grip surface at an end thereof so that the user can get a tactile indication of when a finger of the user is properly positioned to activate said pump assembly.

15. A wearable antibacterial fluid-dispensing bracelet, comprising:

a cartridge comprising a cartridge body defining an interior reservoir for containing a quantity of an antibacterial fluid, an extraction port on said cartridge body for extracting fluid from said interior reservoir, and a fluid transfer conduit having opposite lower and upper ends and being disposed in said interior reservoir of said cartridge body so as to extend from said lower end located proximate a bottom of said cartridge body to said upper end located proximate said extraction port;

a frame comprising a bottom wall, opposite first and second lateral side walls extending from opposite sides of said bottom wall and defining therewith a receptacle conformally shaped to selectively receive said cartridge, and an upper wall extending laterally from an end of said bottom and lateral side walls proximate to said receptacle defined by said bottom and lateral side walls;

a finger-activated pump assembly mounted to said upper wall of said frame proximate to said receptacle of said frame and engaging said extraction port of said cartridge body, said pump assembly comprising an annular-shaped housing affixed to said upper wall of said frame proximate to said receptacle of said frame, said annular-shaped housing comprising an upper portion having a double-walled structure defining an annular slot within said double-walled structure and open at an upper end thereof, and a lower portion connected to said double-walled structure of said upper portion, extending into said cartridge body through said extraction port thereon, and defining a port that fits and communicates with said upper end of said fluid transfer conduit of said cartridge body received by said receptacle of said frame, a piston slidable within and supported by said annular-shaped housing and comprising an exterior walled portion slidable within said annular slot defined by said double-walled structure of said upper portion of said annular-shaped housing such that said piston is translatable between a raised position and a depressed position relative to said annular-shaped housing, an interior walled portion spaced from said exterior walled portion and slidable concurrently therewith and along and inside of said double-walled structure of said upper portion of said annular-shaped housing so as to define an extraction passageway through said piston and in fluid communication with said fluid transfer conduit of said cartridge such that said piston of said piston assembly upon being activated, by a user depressing said piston from said raised position to said depressed position, selectively extracts the fluid from said interior reservoir of said cartridge body through said fluid transfer conduit and extraction port of said cartridge body and said extraction passageway of said piston, a biasing spring disposed within said annular-shaped housing along and engaged with said upper and lower portions thereof and also engaged with said interior walled portion of said piston so as to bias said piston toward said raised position, at least one nozzle port defined on said piston, at a location on said upper portion of said piston disposed beyond said double-walled structure of said upper portion of said annular-shaped housing, in fluid communication with said extraction passageway of said piston to dispense the extracted antibacterial fluid therethrough and from said fluid-dispensing apparatus in response to said depressing said piston from said raised position to said depressed position fixed risers mounted on said upper wall of said frame and disposed on either side of said upper portion of said piston proximate to said nozzle port thereof to protect said piston from inadvertent activation and contact; and a wristband attached to and extending from said frame so as to be extendable about and thus wearable by an arm of a user.

16. The bracelet of claim 15 wherein said frame further comprises:

a pair of side clasps each extending from a respective one of said first and second lateral side walls of said frame into releasable engagement with said cartridge to aid in retaining said cartridge within said receptacle of said frame; and a central clasp extending from said upper wall of said frame for assisting said releasable engagement of said side clasps with said cartridge to aid in retaining said cartridge within said receptacle of said frame.

* * * * *